US010188894B2

(12) United States Patent
Wang

(10) Patent No.: US 10,188,894 B2
(45) Date of Patent: Jan. 29, 2019

(54) BARBELL

(71) Applicant: Hua-Ching Wang, Kaohsiung (TW)

(72) Inventor: Hua-Ching Wang, Kaohsiung (TW)

( * ) Notice: Subject to any disclaimer, the term of this patent is extended or adjusted under 35 U.S.C. 154(b) by 0 days.

(21) Appl. No.: 15/637,027

(22) Filed: Jun. 29, 2017

(65) Prior Publication Data

US 2019/0001178 A1 Jan. 3, 2019

(51) Int. Cl.

| | |
|---|---|
| ***A63B 21/072*** | (2006.01) |
| ***A63B 21/00*** | (2006.01) |
| ***A63B 21/075*** | (2006.01) |
| *A63B 21/06* | (2006.01) |

(52) U.S. Cl.

CPC ..... *A63B 21/0724* (2013.01); *A63B 21/075* (2013.01); *A63B 21/0728* (2013.01); *A63B 21/4049* (2015.10); *A63B 21/00* (2013.01); *A63B 21/06* (2013.01)

(58) Field of Classification Search

CPC ..... A63B 21/0724; A63B 21/4049; A63B 21/0728; A63B 21/075; A63B 21/06; A63B 21/00

USPC ..... 482/106; D21/681

See application file for complete search history.

(56) References Cited

U.S. PATENT DOCUMENTS 734,062 A * 7/1903 Harris ..... A63B 21/0726 482/108
1,658,108 A * 2/1928 Vaughn ..... A63B 15/00 482/109
2,617,650 A * 11/1952 Landis ..... A63B 21/072 482/108
D271,407 S * 11/1983 Wright ..... D21/682
4,607,840 A * 8/1986 Harper ..... A63B 21/072 482/108
4,743,017 A * 5/1988 Jaeger ..... A63B 21/075 482/108
4,756,526 A * 7/1988 Broussard ..... A63B 21/0724 482/108
4,768,780 A * 9/1988 Hayes ..... A63B 21/0724 482/106
4,943,052 A * 7/1990 Powers ..... A63B 21/0724 482/106
4,964,631 A * 10/1990 Marano ..... A63B 21/4013 482/105
D315,003 S * 2/1991 Huang ..... D21/682
5,088,725 A * 2/1992 Arnold ..... A63B 21/072 482/97
5,110,119 A * 5/1992 Arnold ..... A63B 21/4017 482/108
5,281,192 A * 1/1994 Nelson ..... A63B 15/00 482/105

(Continued)

*Primary Examiner* — Andrew S Lo
(74) *Attorney, Agent, or Firm* — Alan D. Kamrath; Kamrath IP Lawfirm, P.A.

(57) ABSTRACT

A barbell includes a grip unit, a support unit and a carrier unit. The grip unit includes two frames spaced apart from each other along a first direction, and a grip rod connected between the frames and configured to be gripped by a user's hand. The support unit includes at least one support member that is connected between the frames, that is spaced apart from the grip rod along a second direction transverse to the first direction, and that is configured to abut against a user's forearm. The carrier unit includes two hanging rods extending outwardly and respectively from the frames and located between the grip rod and the at least one support member.

6 Claims, 11 Drawing Sheets

(56) References Cited

U.S. PATENT DOCUMENTS 5,350,345 A * 9/1994 Frey ..... A63B 21/072 482/105
5,540,640 A * 7/1996 Povilaitis ..... A63B 21/072 482/106
5,573,484 A * 11/1996 Carpenter ..... A63B 21/00181 482/108
5,725,461 A * 3/1998 Bogard, II ..... A63B 21/072 482/106
D398,675 S * 9/1998 Marney ..... D21/681
D398,676 S * 9/1998 Marney ..... D21/681
5,941,805 A * 8/1999 Copelin ..... A63B 21/078 446/482
5,957,818 A * 9/1999 Betournay ..... A63B 21/065 482/105
5,971,339 A * 10/1999 Falasco, Jr. ..... A63B 21/4017 248/175
6,001,049 A * 12/1999 Frey ..... A63B 21/0603 482/105
6,213,921 B1 * 4/2001 Frey ..... A63B 21/0603 482/105
6,340,341 B1 * 1/2002 Purcell ..... A63B 21/065 482/106
6,572,515 B2 * 6/2003 De La Garza ..... A63B 21/0724 482/106
D498,272 S * 11/2004 Sanford-Schwentke .... D21/681
6,945,918 B1 * 9/2005 Hill ..... A63B 21/0724 482/104
7,097,601 B1 * 8/2006 Ronnow ..... A63B 21/072 482/106
7,303,507 B1 * 12/2007 Jozsa ..... A63B 21/072 482/109
8,337,372 B1 * 12/2012 Boterenbrood ..... A01B 1/02 294/49
8,992,395 B2 * 3/2015 Orakwusi ..... A63B 21/1636 482/106
2002/0119872 A1 * 8/2002 Greenheck ..... A63B 21/072 482/93
2004/0063553 A1 * 4/2004 Viscount ..... A63B 21/065 482/107
2004/0185989 A1 * 9/2004 Emick ..... A63B 21/4035 482/106
2004/0198568 A1 * 10/2004 Stonecipher ..... A63B 21/0023 482/106
2004/0242385 A1 * 12/2004 Emick ..... A63B 21/0724 482/106
2006/0040802 A1 * 2/2006 Vittone ..... A63B 21/0724 482/106
2008/0026920 A1 * 1/2008 Berenshteyn ..... A63B 21/0724 482/106
2010/0323854 A1 * 12/2010 Brandenburg ..... A63B 21/0724 482/106
2014/0187392 A1 * 7/2014 Renk ..... A63B 21/072 482/106
2014/0200119 A1 * 7/2014 Sides, Jr. ..... A63B 21/0618 482/106
2014/0287889 A1 * 9/2014 Grace ..... A63B 21/0728 482/106
2016/0175640 A1 * 6/2016 Kempton ..... A63B 21/0726 482/107

* cited by examiner

BARBELL

FIELD

The disclosure relates to an exercising apparatus, and more particularly to a barbell.

BACKGROUND

A barbell is an exercising apparatus having a certain weight, and can be used to train the muscle groups of the user's upper arm and the other body parts by performing different operational positions. The weight of a conventional barbell is fixed and cannot be adjusted, so that use of the conventional barbell is limited. Further, barbells having different weights and sizes occupy a substantial storage space.

Referring to FIG. 1, a conventional barbell 1 includes a grip rod 11, a plurality of weight plates 12 mounted on two opposite ends of the grip rod 11, and two limiting members 13 fixed to the ends of the grip rod 11 and located at outer sides of the weight plates 12. When the limiting members 13 are removed, a user can replace weight plates 12 with different weights and add or reduce the number of the weight plates 12 according to his/her personal requirement, thereby enhancing the versatility thereof.

To use the conventional barbell 1, the user's hand grips the grip rod 11, and then performs various exercising positions to train the upper arm, chest muscle, back muscle, and muscles of other body parts. However, the distance between the grip rod 11 and the elbow is long, so that when the barbell 1 is lifted to perform various exercising positions, the muscle of the forearm will bear a large torque. It is generally understood that when using the barbell for training the relevant muscles, use of the forearm muscle is often greater than that of muscles of other body parts, so that the forearm muscle feel tired faster than the muscles of the other body parts. As a result, the user has to stop the exercise, and the training of the muscles of the other body parts cannot be achieved.

SUMMARY

Therefore, an object of the present disclosure is to provide a barbell that can reduce the burden on the user's forearm so that the muscles of the relevant body parts can be sufficiently trained and strengthened.

According to this disclosure, a barbell comprises a grip unit, a support unit and a carrier unit. The grip unit includes two frames spaced apart from each other along a first direction, and a grip rod connected between the frames and configured to be gripped by a user's hand. The support unit includes at least one support member that is connected between the frames, that is spaced apart from the grip rod along a second direction transverse to the first direction, and that is configured to abut against a user's forearm. The carrier unit includes two hanging rods extending outwardly and respectively from the frames and located between the grip rod and the at least one support member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
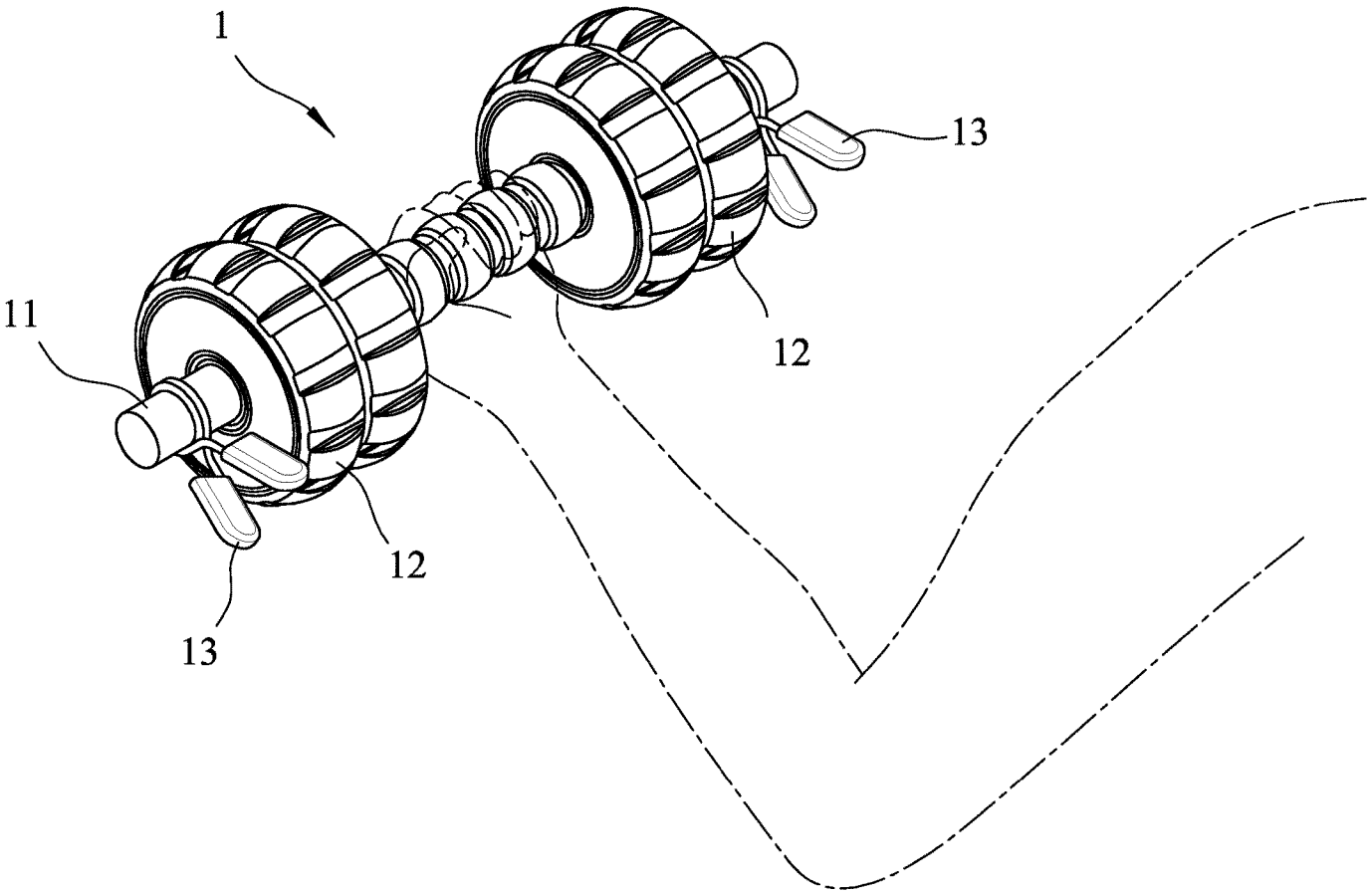
FIG.1 PRIOR ART
FIG. 1 is a perspective view of a conventional barbell in a state of use.
Figure 2:
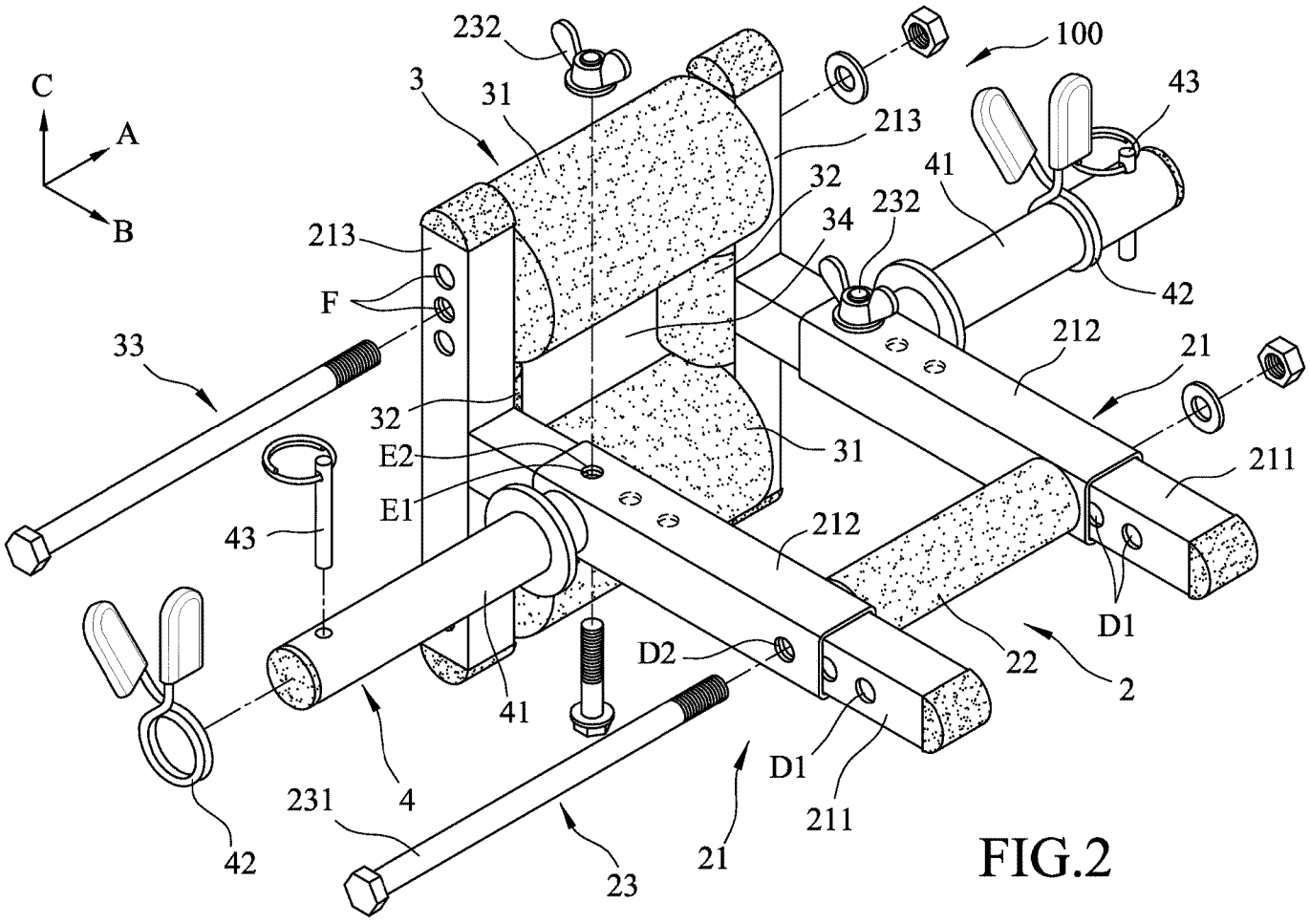
FIG. 2 is an exploded perspective view of a barbell according to the embodiment of the present disclosure.
Figure 3:
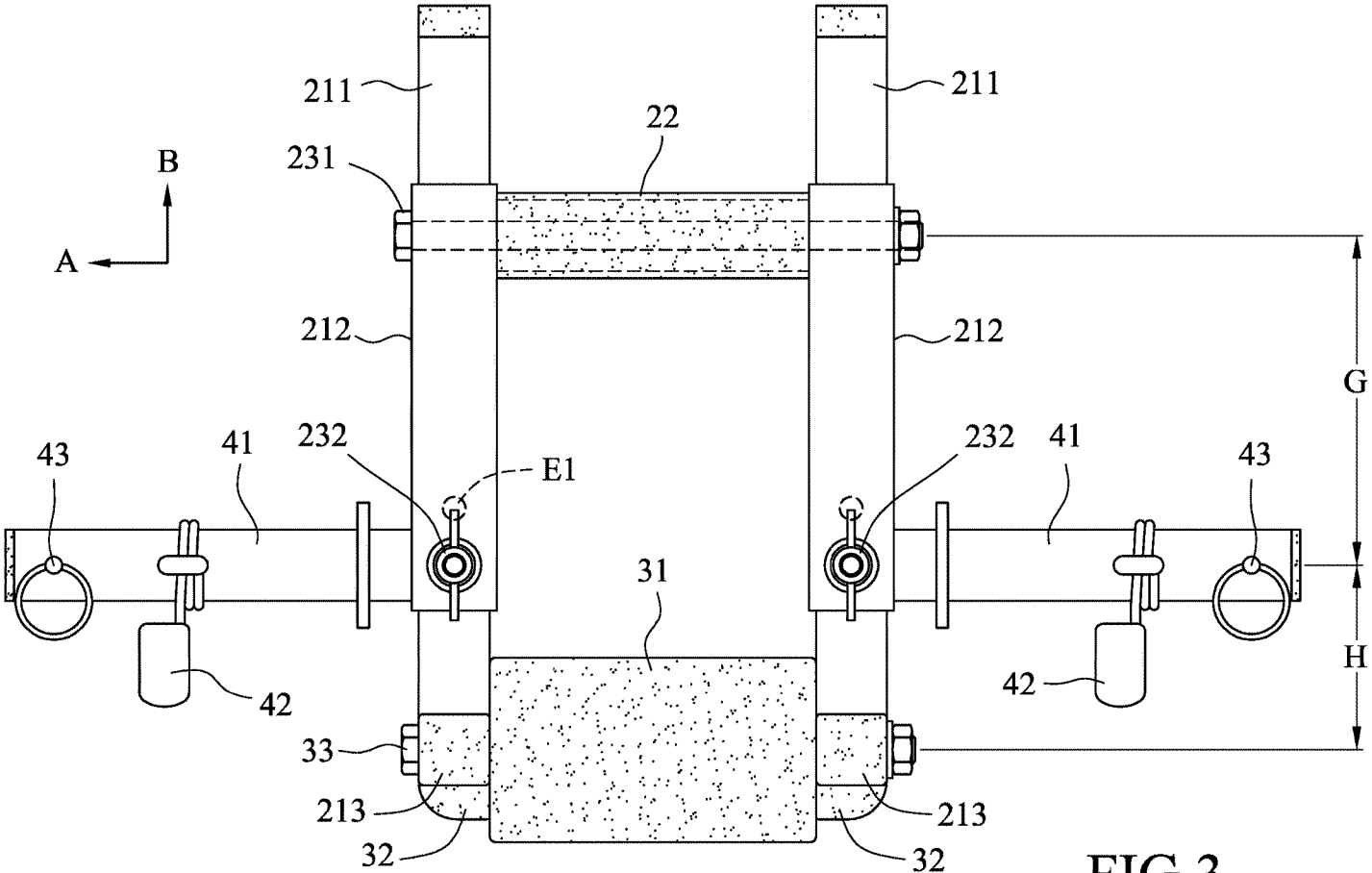
FIG. 3 is a schematic top view of the embodiment in an assembled state.
Figure 4:
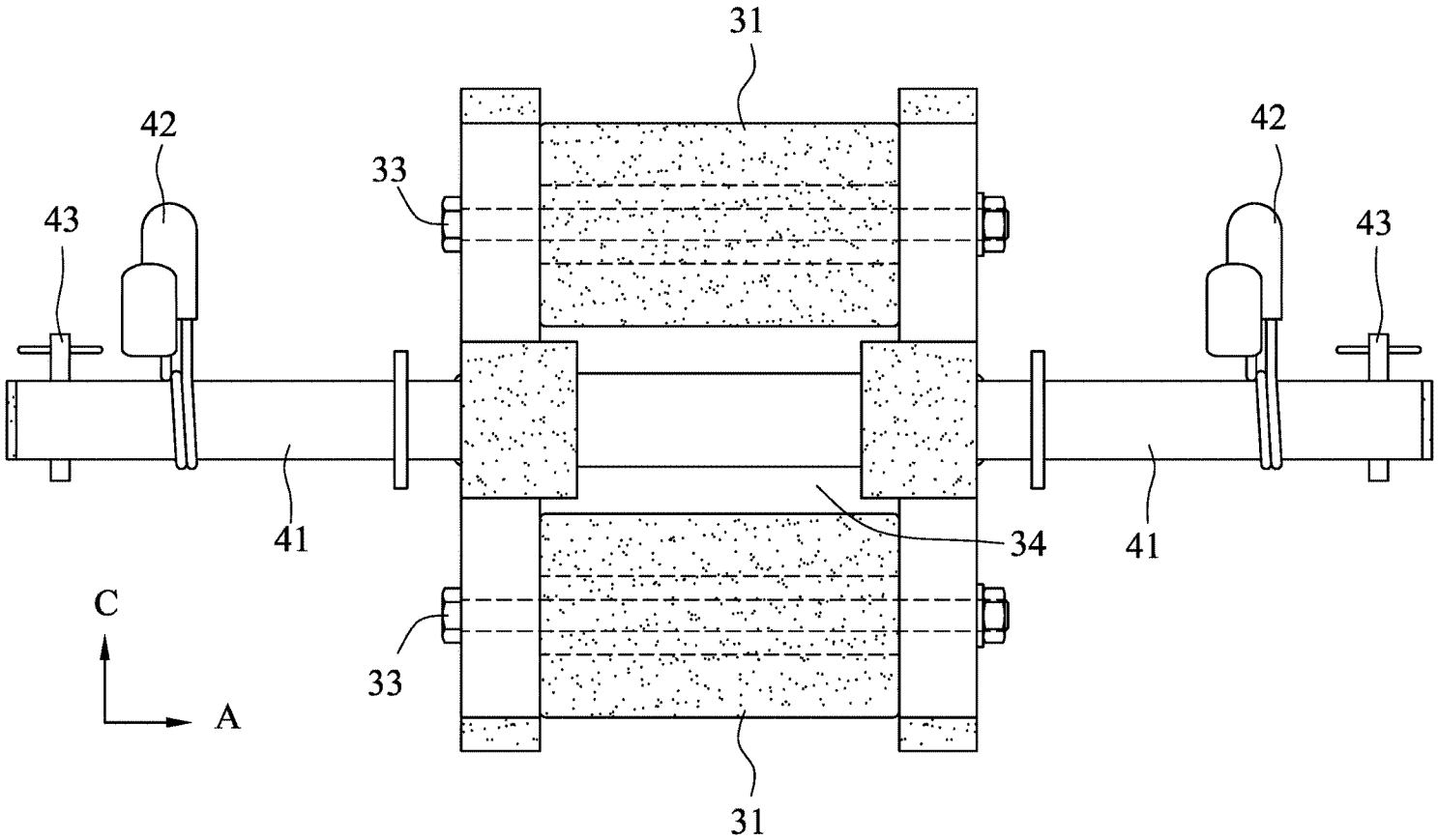
FIG. 4 is a schematic rear view of the embodiment.

Referring to FIGS. 2 to 4, a barbell 100 according to the embodiment of the present disclosure is shown to include a grip unit 2, a support unit 3 and a carrier unit 4.

The grip unit 2 includes two frames 21 spaced apart from each other along a first direction (A) which is a left-right direction, a hollow grip rod 22 connected between the two frames 21 and configured to be gripped by a user's hand, and a fixing mechanism 23. Each frame 21 includes a main rod 211 extending along a second direction (B) which is a front-rear direction and which is transverse to the first direction (A), a tubular sleeve 212 sleeved on the main rod 211, and a supporting rod 213 having a central portion connected to a rear end of the main rod 211 and extending in a third direction (C) which is a top-bottom direction and which is transverse to the first and second directions (A, B).

Figure 5:
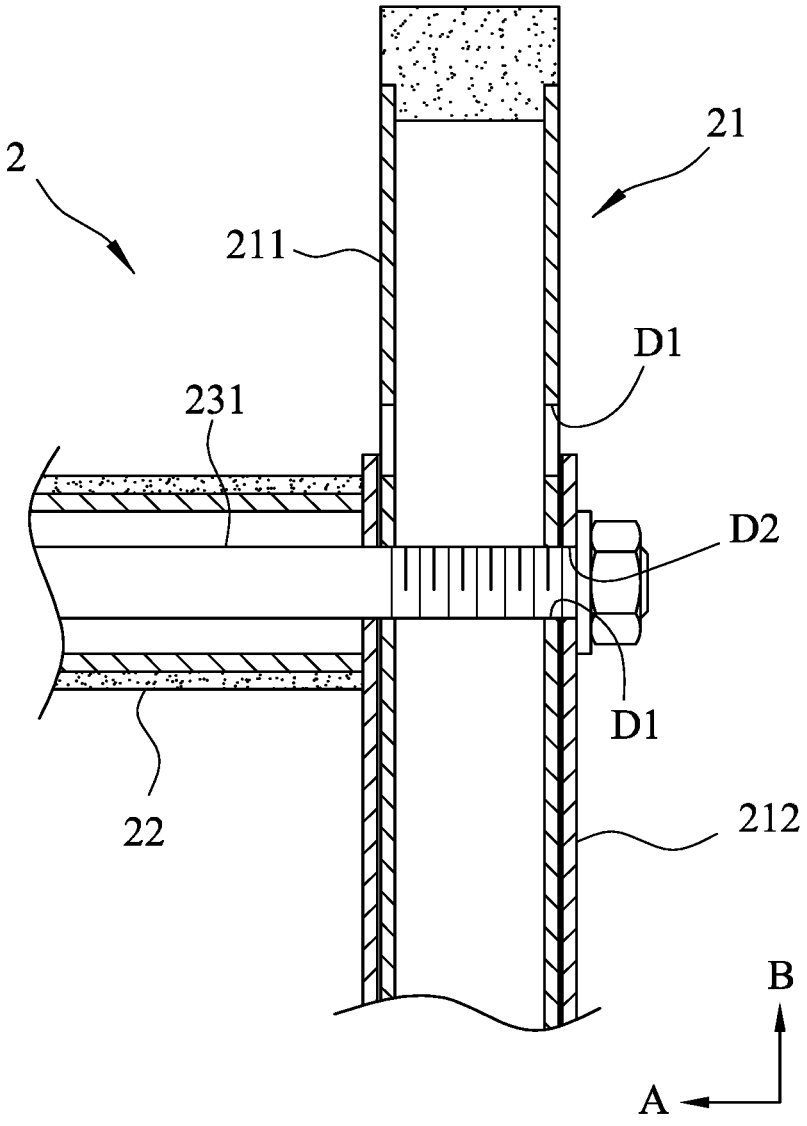
FIG. 5 is a fragmentary sectional view of the embodiment, illustrating how a fixing member is connected to a main rod and a tubular sleeve.
Figure 6:
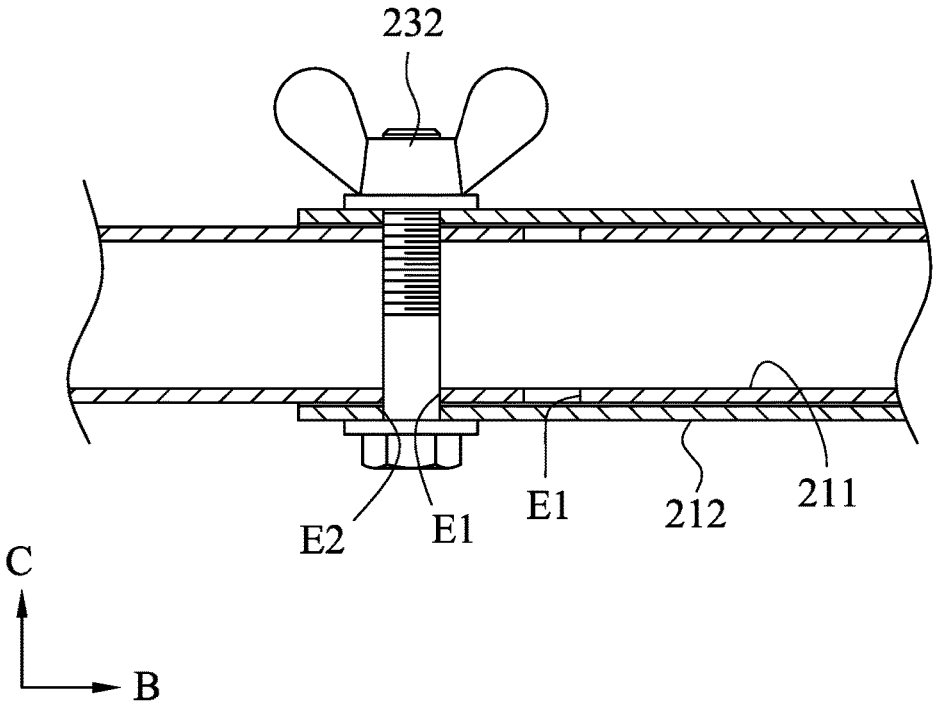
FIG. 6 is another fragmentary sectional view of the embodiment, illustrating how a pressing member is connected to the main rod and the tubular sleeve.

Referring to FIGS. 2, 5 and 6, the main rod 211 has a front end portion provided with a plurality of pairs of first through holes (D1) spaced apart from each other along the second direction (B) and extending through left and right sides thereof, and a rear end portion provided with a plurality of pairs of second through holes (E1) spaced apart from each other along the second direction (B) and extending through top and bottom sides thereof. The tubular sleeve 212 has a front end portion provided with a pair of third through holes (D2) extending through left and right sides thereof and corresponding to one of the pairs of first through holes (D1), and a rear end portion provided with a pair of fourth through holes (E2) extending through top and bottom sides thereof and selectively corresponding to one of the pairs of second through holes (E1). The tubular sleeve 212 is movable relative to the main rod 211 along the second direction (B) to change its position on the main rod 211. The supporting rod 213 has top and bottom end portions symmetrically formed with a plurality of pairs of fifth through holes (F) extending through left and right sides thereof and spaced apart from each other along the third direction (C).

The fixing mechanism 23 includes a fixing member 231 and two pressing members 232. The fixing member 231 extends through the pair of third through holes (D2) in the tubular sleeve 212 of one of the frames 21, a corresponding one of the pairs of first through holes (D1) in the main rod 211 of the one of the frames 21, the grip rod 22, the pair of third through holes (D2) in the tubular sleeve 212 of the other frame 21 and a corresponding one of the pairs of first through holes (D1) in the main rod 211 of the other frame 21. Each pressing member 232 extends through the pair of fourth through holes (E2) in the tubular sleeve 212 of one of the frames 21 and a selected one of the pairs of second through holes (E1) in the main rod 211 of the one of the frames 21. In this embodiment, the fixing member 231 includes an elongated bolt and a hexagonal screw nut, and each pressing member 232 includes a screw bolt and a wing nut.

With reference to FIGS. 2 to 4, the support unit 3 includes two hollow support members 31 that are spaced part from each other along the third direction (C), that are connected between the supporting rods 213 of the frames 21 and that are spaced apart from the grip rod 22 along the second direction (B), two cushions 32 respectively disposed on the right side of the supporting rod 213 of one of the frames 21 and the left side of the supporting rod 213 of the other frame 21 and located between the support members 31, and two adjustment members 33 (see FIGS. 2 and 10) spaced apart from each other along the third direction (C). Each support member 31 extends along the first direction (A). Each cushion 32 extends along the third direction (C). Each adjustment member 33 extends through one of the pairs of fifth through holes (F) in the supporting rod 213 of one of the frames 21, a corresponding one of the support members 31, and a corresponding one of the pairs of fifth through holes (F) in the supporting rod 213 of the other frame 21. The support members 31 and the cushions 32 cooperatively define an insert opening 34 extending along the second direction (B) and configured to allow extension of a user's forearm 6 therethrough. In this embodiment, each adjustment member 33 includes an elongated bolt and a hexagonal screw nut.

The carrier unit 4 includes two hanging rods 41 that are connected to and that extend outwardly and respectively from the tubular sleeves 212 along the first direction (A) at positions corresponding to the respective pressing members 232 and that are arranged in a straight line, two limiting members 42 fixed removably and respectively to the hanging rods 41, and two insert pins 43 inserted removably and respectively into the hanging rods 41 and respectively located at outer sides of the limiting members 42 to prevent the limiting members 42 from moving out of the respective hanging rods 41. Each hanging rod 41 is spaced apart from the grip rod 22 along the second direction (B) by a distance (G) which is greater than or equal to a distance (H) between each hanging rod 41 and one of the support members 31. Each of the distances (G, H) is measured from the axes of the corresponding components.

Figure 7:
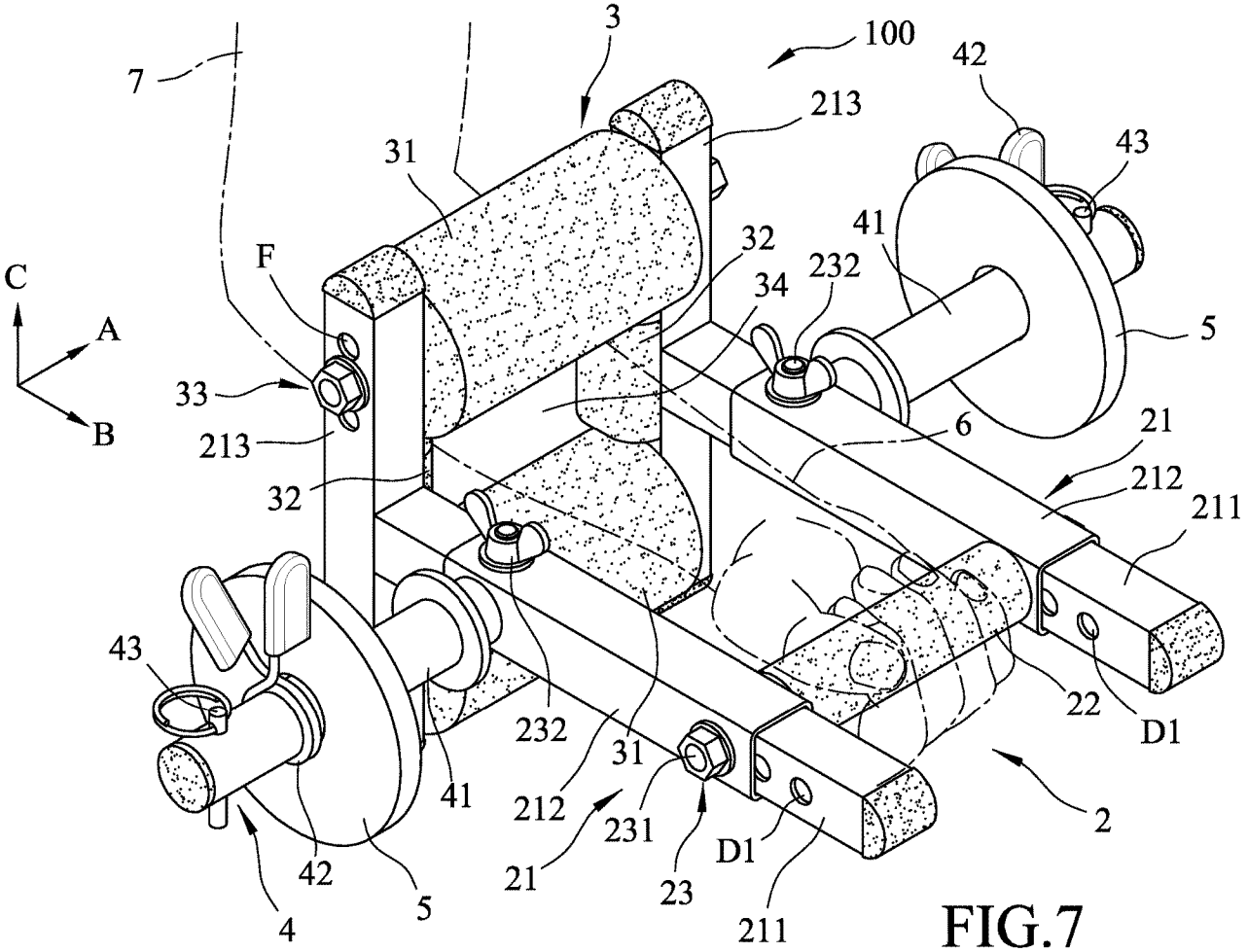
FIG. 7 is an assembled perspective view of the embodiment in a state of use.

Referring to FIG. 7, in combination with FIGS. 2 and 3, the barbell 100 can be used with two or more weight plates 5, and each hanging rod 41 thereof may be mounted with at least one weight plate 5. In this embodiment, each limiting member 42 is a spring clip configured to limit and fix the weight plate 5 disposed on the same side thereof, and the insert pins 43 are used as a second protective measure to prevent the limiting members 42 and the weight plates 5 from moving out of the respective hanging rods 41. That is, when the limiting members 42 cannot stop the weight plates 5 but move along therewith, the insert pins 43 will stop and limit the movement of the limiting members 42 and the weight plates 5, thereby preventing falling of these components.

In use, a user first extends his/her forearm 6 through the insert opening 34 to grip the grip rod 22, as shown in FIG. 7, after which the user can bend his/her arm to move his/her forearm 6 upward and downward to start the exercise. During bending, the forearm 6 must overcome the weights of the weight plates 5 mounted on the hanging rods 41. Thus, the user's forearm 6, upper arm 7, chest muscles, back muscles and muscles of other body parts all exert forces to achieve the training effect. The user may also increase the number of the weight plates 5 on the hanging rods 41 to increase the weight of the barbell 100. During training, the support members 31 abut against the forearm 6. Since the distance between the support members 31 and the user's elbow is shorter than that between the grip rod 22 and the user's elbow, in comparison with the conventional barbell, the use of the barbell 100 will allow the forearm 6 to bear a smaller force. Furthermore, since the distance (G) between each hanging rod 41 and the grip rod 22 along the second direction (B) is greater than or equal to the distance (H) between each hanging rod 41 and one of the support members 31, after the weight plates 5 are mounted, the center of gravity of this embodiment will be close to the support members 31, so that most of the weight of the weight plates 5 is applied to the part of the forearm 6 that is in abutment contact with the support members 31, thereby significantly reducing the burden on the muscles of the forearm 6. At the same time, the upper arm 7, the chest muscles and the muscles of other body parts can obtain their intended training and strength.

Figure 8:
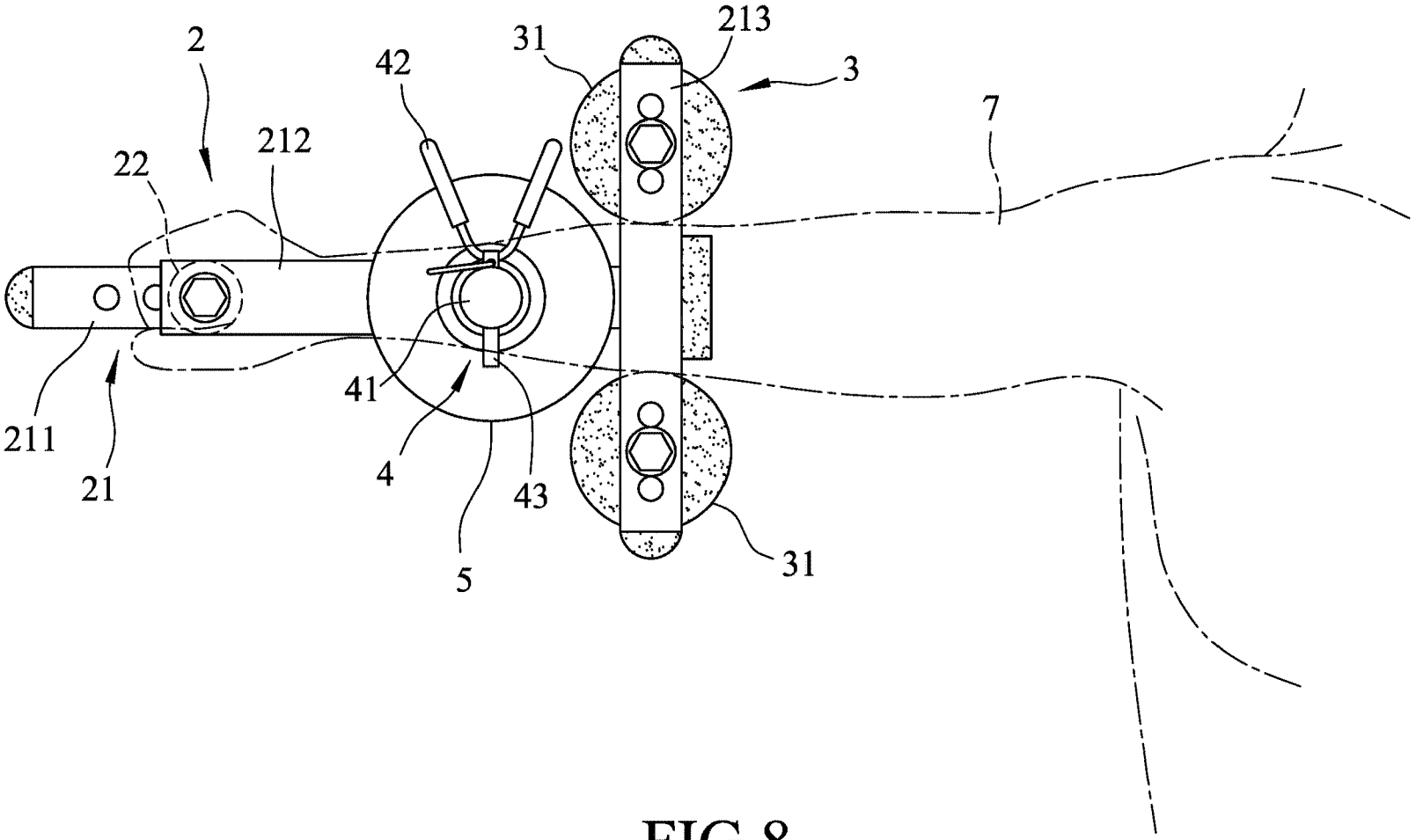
FIG. 8 illustrates another state of use of the embodiment.
Figure 11:
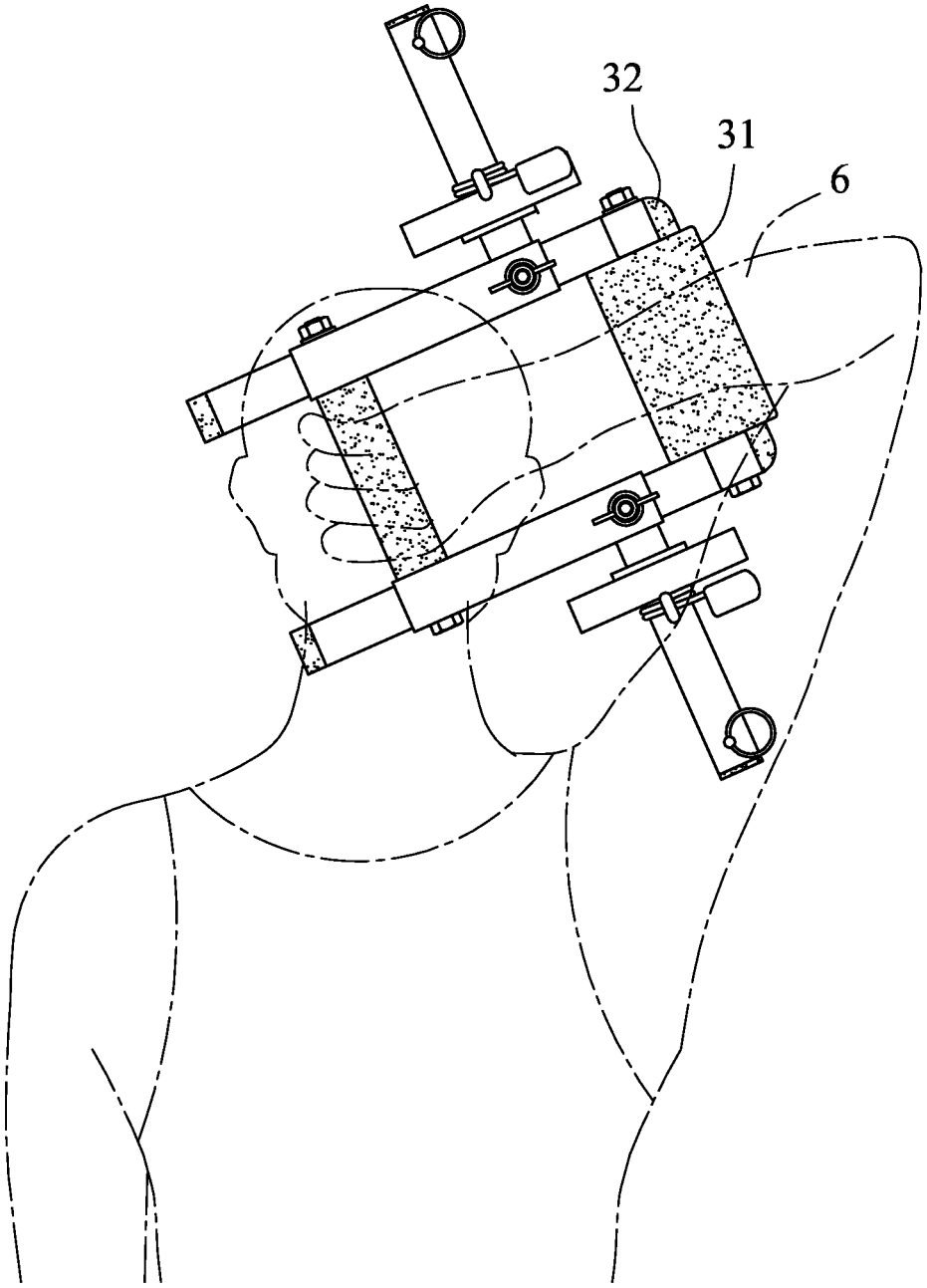
FIG. 11 illustrates still another state of use of the embodiment.

Moreover, because the two support members 31 and the two cushions 32 of the disclosure surround the user's forearm 6, the training does not only involve bending the elbow and raising the forearm, but it may also involve raising the arm of the user sideward in a straight manner to train the deltoid and trapezius muscles, as shown in FIG. 8, or placing the forearm 6 behind the user's head to perform a one arm barbell triceps extension exercise, as shown in FIG. 11. When the user performs different forms of exercises, the use of the support members 31 and the cushions 32 that abut against the forearm 6 not only can reduce the burden on the forearm 6, but also can clamp and limit the forearm 6. As such, even when the grip rod 22 is accidentally released during exercise, the barbell 100 of this disclosure will not easily fall and escape from the user's hand. Hence, stability and safety protection during exercise can be effectively enhanced.

Figure 9:
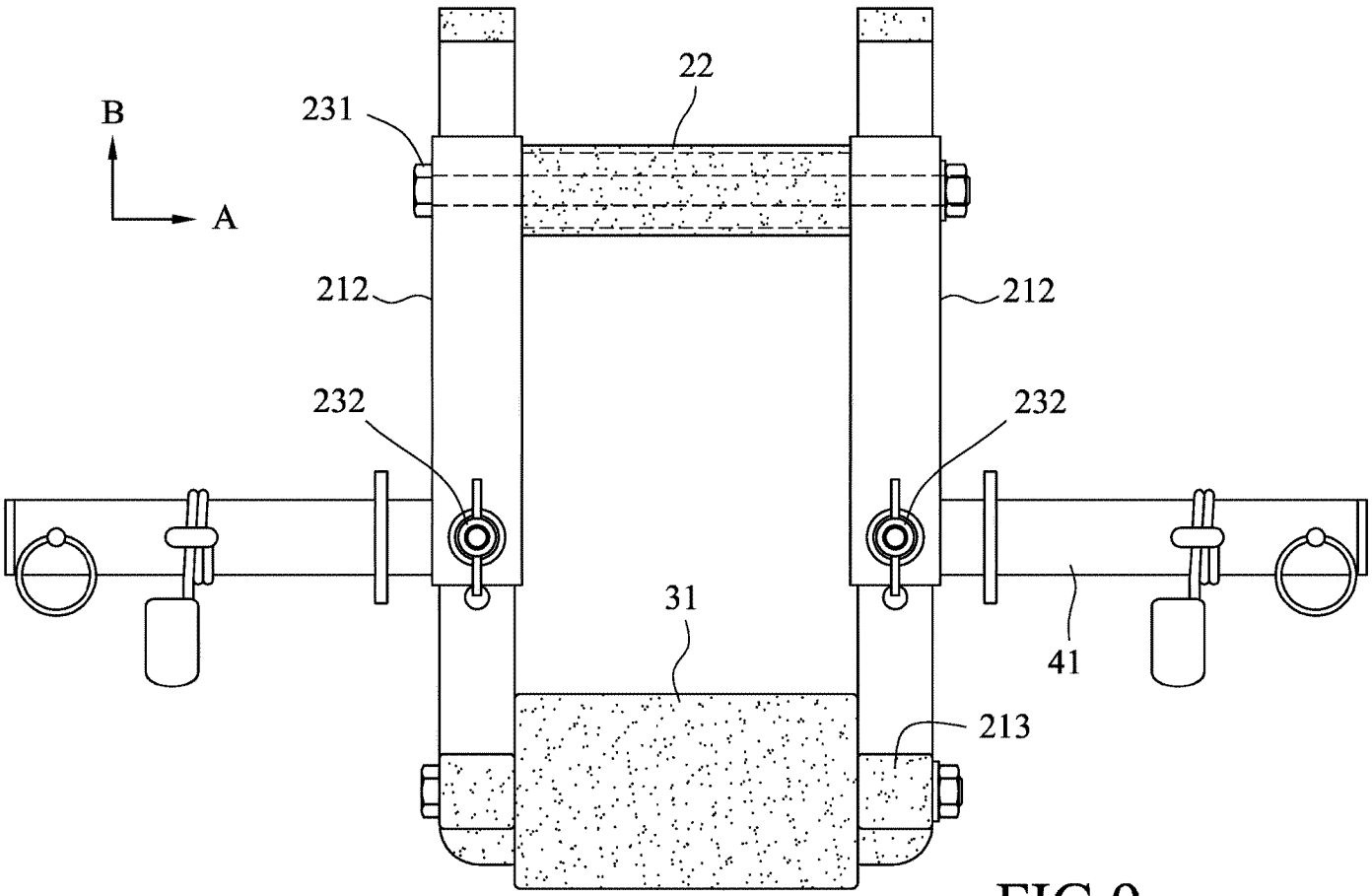
FIG. 9 is a view similar to FIG. 3, but with positions of two tubular sleeves being adjusted along a second direction.

Referring to FIGS. 2, 7 and 9, when the fixing member 231 and the pressing members 232 are loosened and removed, the user can adjust the position of the tubular sleeves 212 relative to the respective main rods 211 along the second direction (B) according to the length of his/her forearm 6 and the desired application of force. After the tubular sleeves 212 are moved to the desired position with the pair of third through holes (D2) in each tubular sleeve 212 aligning with one of the pairs of first through holes (D1) in the corresponding frame 21 and with the pair of fourth through holes (E2) in each tubular sleeve 212 aligning with one of the pairs of second through holes (E1) in the corresponding frame 21, the fixing member 231 is extended through the aligned first and third through holes (D2, D1) and tightened, and each pressing member 232 is extended through the aligned second and fourth through holes (E1, E2) and tightened. As such, the distance between the grip rod 22 and the support members 31 and the distance between the hanging rods 41 and the support members 31 are adjusted, thereby effectively enhancing the versatility of the disclosure. Further, since the fixing member 231 and the hanging rods 41 are located on the front and rear end portions of the tubular sleeves 212, the user can tightly fasten the pressing members 232 to press the tubular sleeves 212 against the main rods 211 of the frames 21 so as to increase the fixing strength of the tubular sleeves 212. During adjustment of the position of the tubular sleeves 212, the hanging rods 41 move synchronously with the grip rod 22, so that the weight plates 5 mounted on the hanging rods 41 are also moved accordingly to match the user's body and to alter the position of the center of gravity, thereby achieving the effect of sharing the weight of the weight plates 5 to reduce the burden of the forearm 6.

Figure 10:
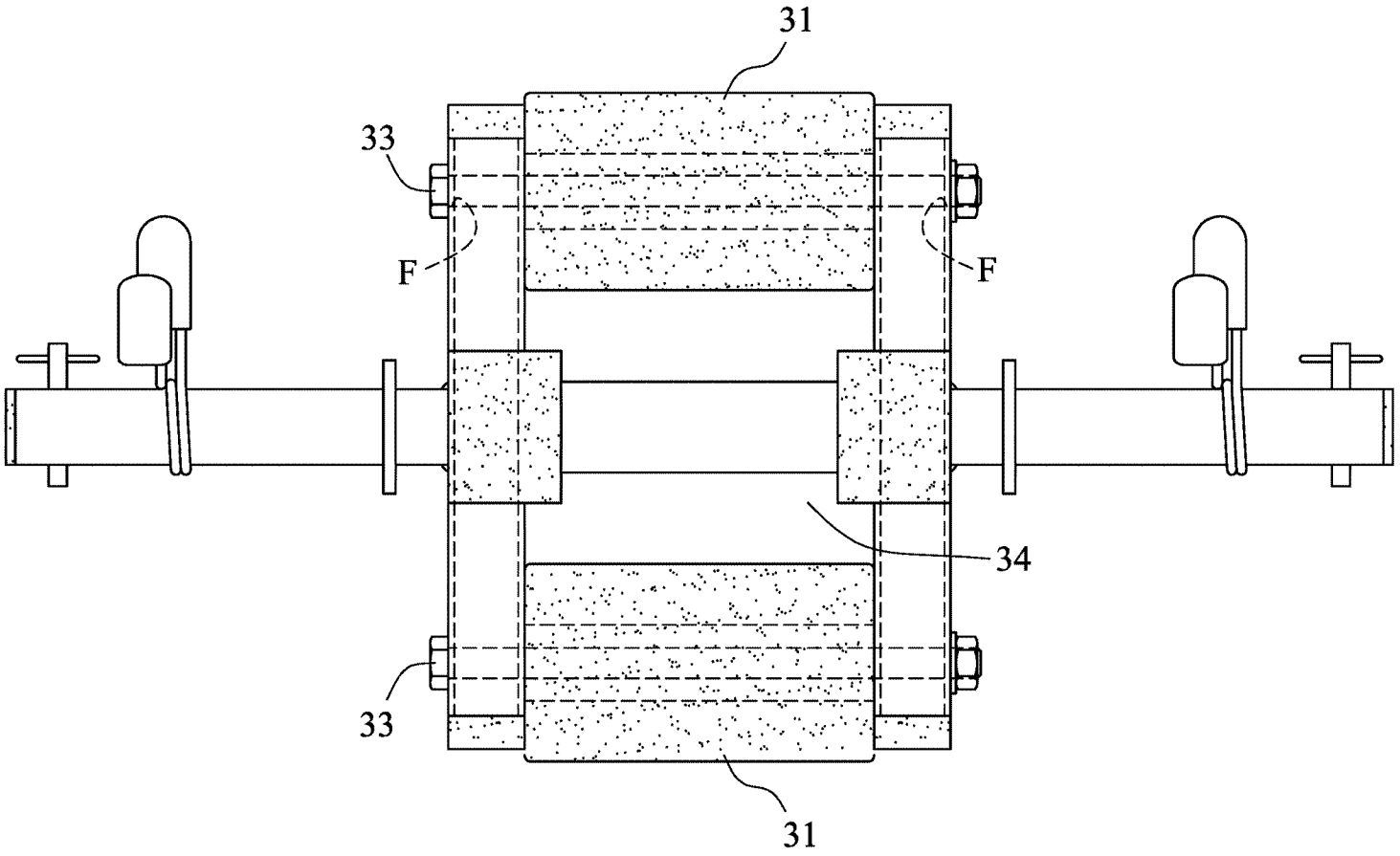
FIG. 10 is a view similar to FIG. 4, but with positions of two support members being adjusted along a third direction.

Referring to FIGS. 2, 7 and 10, when one of the adjustment members 33 is loosened and detached from the supporting rods 213, the corresponding support member 31 can be removed and then re-aligned with another one of the pairs of fifth through holes (F) in one of the supporting rods 213 and another one of the pairs of fifth through holes (F) in the other supporting rod 213. Afterwards, the detached adjustment member 33 is re-inserted into the aligned pairs of fifth through holes (F) and the corresponding support member 31 so as to fix the corresponding support member 31 to an appropriate height or level. Through this, the distance between the two support members 31 is changed to adjust the size of the insert opening 34 according to the thickness of the user's arm. Thus, this disclosure can be used for users having different body types, and the versatility thereof is further enhanced.

From the forgoing, it is evident that most of the weight of the weight plates 5 is applied to the part of the forearm 6 through the support members 31 and the cushions 32. Since the support members 31 and the cushions 32 are close to the user's elbow, the length of the arm of force of the forearm 6 can be reduced, so that the burden on the muscles of the forearm can also be minimized to ensure that the upper arm 7 and the muscles of other body parts can be sufficiently trained and strengthened. Further, by using the fixing mechanism 23 to adjust the distance between the grip rod 22 and the support members 31 so as to correspond to the different lengths of forearms 6, and by using the adjustment members 33 to adjust the size of the insert opening 34 to correspond to the different thicknesses of forearms 6, the versatility of the disclosure can be effectively increased.

With reference to FIG. 11, generally, when the user performs an exercise involving a large action, such as the one arm barbell triceps extension exercise, the barbell is prone to accidentally escape from the user's hand and fall off to cause injury to the user. However, when the barbell 100 of this disclosure is used to perform the aforesaid exercise, because the support members 31 and the cushions 32 are used to limit the forearm 6, the barbell 100 can be prevented from escaping from the user's hand. Hence, safety protection thereof can be effectively improved.

The object of this disclosure can thus be realized.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A barbell comprising:

a grip unit including two frames spaced apart from each other along a first direction, and a grip rod connected between said frames and configured to be gripped by a user's hand;

a support unit including two support members that are connected between said frames, that are spaced apart from said grip rod along a second direction transverse to the first direction, and that are configured to abut against a user's forearm, said support members being spaced apart from each other along a third direction transverse to the first and second directions, each of said support members extending along the first direction; and a carrier unit including two hanging rods extending outwardly and respectively from said frames and located between said grip rod and said support members;

wherein said hanging rods extend along the first direction and are arranged in a straight line, and said grip rod is spaced apart from said hanging rods along the second direction by a distance greater than or equal to a distance between said support members and said hanging rods along the second direction; and wherein each of said frames includes a main rod, a tubular sleeve sleeved on said main rod and connected to a respective one of said hanging rods and one end of said grip rod, and a supporting rod connected to said main rod and extending along the third direction, said support members being connected between said supporting rods of said frames, said tubular sleeve being movable relative to said main rod along the second direction to change its position on said main rod, said grip unit further including a fixing mechanism to fix said tubular sleeves of said frames to said main rods of said frames, respectively.

2. The barbell as claimed in claim 1, wherein said fixing mechanism includes a fixing member extending through said tubular sleeves, said main rods and said grip rod along the first direction, and two pressing members each of which extends through one of said tubular sleeves and a corresponding one of said main rods along the third direction and each of which is located at a position corresponding to a respective one of said hanging rods.

3. The barbell as claimed in claim 2, wherein said support unit further includes two cushions that are respectively disposed on said supporting rods, that extend along the third direction, and that are located between said support members, said cushions and said support members cooperatively defining an insert opening configured to allow extension of the user's forearm therethrough.

4. The barbell as claimed in claim 3, wherein said support unit further includes two adjustment members to fix said support members between said supporting rods, each of said adjustment members being adjustable relative to said supporting rods to change the position of a corresponding one of said support members along the third direction, thereby changing the size of said insert opening.

5. A barbell comprising:

a grip unit including two frames spaced apart from each other along a first direction, and a grip rod connected between said frames and configured to be gripped by a user's hand;

a support unit including two support members that are connected between said frames, that are spaced apart from said grip rod along a second direction transverse to the first direction, and that are configured to abut against a user's forearm; and a carrier unit including two hanging rods extending outwardly and respectively from said frames and located between said grip rod and said support members, said carrier unit further including two limiting members fixed removably and respectively to said hanging rods, and two insert pins inserted removably and respectively into said hanging rods and respectively located at outer sides of said limiting members to prevent said limiting members from moving out of said hanging rods, respectively.

6. The barbell as claimed in claim 5, wherein each of said limiting members is a spring clip.

* * * * *